US009789882B2

(12) United States Patent
Dalske et al.

(10) Patent No.: US 9,789,882 B2
(45) Date of Patent: Oct. 17, 2017

(54) DOOR SEALING ASSEMBLY FOR A RAILCAR AND METHOD OF ASSEMBLING THE SAME

(71) Applicant: American Railcar Industries, Inc., St. Charles, MO (US)

(72) Inventors: Roger Dalske, Florissant, MO (US); Spencer Ashie-Winns, St. Charles, MO (US); Hariharanath Kavuri, Andhra Pradesh (IN); John Birkmann, St. Charles, MO (US)

(73) Assignee: American Railcar Industries, Inc., St. Charles, MO (US)

( * ) Notice: Subject to any disclaimer, the term of this patent is extended or adjusted under 35 U.S.C. 154(b) by 47 days.

(21) Appl. No.: 14/505,613

(22) Filed: Oct. 3, 2014

(65) Prior Publication Data

US 2015/0096458 A1 Apr. 9, 2015

Related U.S. Application Data

(60) Provisional application No. 61/887,653, filed on Oct. 7, 2013.

(51) Int. Cl.

| | |
|---|---|
| ***B61D 7/22*** | (2006.01) |
| ***B61D 7/16*** | (2006.01) |
| ***B61D 7/02*** | (2006.01) |

(52) U.S. Cl.

CPC ..... *B61D 7/22* (2013.01); *B61D 7/02* (2013.01); *B61D 7/16* (2013.01); *Y10T 29/4984* (2015.01)

(58) Field of Classification Search

CPC ... B61D 7/00; B61D 7/02; B61D 7/14; B61D 7/16; B61D 7/18; B61D 7/22; B61D 7/24

USPC ..... 105/238.1, 239, 247, 248, 280, 281, 105/283–285

See application file for complete search history.

(56) References Cited

U.S. PATENT DOCUMENTS

| | | | | |
|---|---|---|---|---|
| 734,977 | A | 7/1903 | Simonton | |
| 776,149 | A | 11/1904 | Simonton | |
| 1,014,768 | A | 1/1912 | Meissner | |
| 1,099,878 | A | 6/1914 | Hopkins | |
| 2,602,402 | A | 7/1952 | Sanford, Jr. et al. | |
| 2,863,402 | A | 12/1958 | Ford | |
| 3,169,491 | A | 2/1965 | Darlington et al. | |
| 3,339,500 | A | 9/1967 | Dorey | |
| 3,455,253 | A | 7/1969 | Floehr | |
| 4,222,334 | A | 9/1980 | Peterson | |
| 4,366,757 | A * | 1/1983 | Funk | B61D 7/26 105/248 |
| 8,485,110 | B2 | 7/2013 | Gaydos et al. | |
| 8,596,203 | B2 | 12/2013 | Forbes et al. | |
| 8,622,004 | B2 | 1/2014 | Forbes et al. | |

* cited by examiner

*Primary Examiner* — R. J. McCarry, Jr.
(74) *Attorney, Agent, or Firm* — Dunlap Codding, P.C.

(57) ABSTRACT

A railcar door sealing assembly includes a first door seal member coupled to a first door plate of a first door of the railcar. The door sealing assembly also includes a second door seal member coupled to a second door plate of a second door of the railcar. The first door seal member at least partially overlaps with the second door seal member in a face-to-face relationship when the first door and the second door are in the closed position.

10 Claims, 7 Drawing Sheets

DOOR SEALING ASSEMBLY FOR A RAILCAR AND METHOD OF ASSEMBLING THE SAME

CROSS REFERENCE TO RELATED APPLICATIONS

This application claims the priority of Provisional Patent Application Ser. No. 61/887,653, entitled "DOOR SEALING ASSEMBLY FOR A RAILCAR AND METHOD OF ASSEMBLING THE SAME", which was filed on Oct. 7, 2013, and which is hereby incorporated by reference in its entirety.

BACKGROUND

The present disclosure relates generally to railroad (railway) cars, or railcars and related components, and more particularly to a door sealing assembly for a railcar and a method of assembling the same with such a door sealing assembly.

Railcars have been used for many years to transport a wide variety of commodities. For example, railway tank cars transport fluids including liquids, e.g., demineralized water, and gasses, e.g., hydrogen. Also, for example, railway hopper cars transport flowable solids including coal, grains, and rock.

Many known railcars include a pair of lower doors to facilitate for the unloading of commodities stored in the railcars. For instance, gondola cars include gondola doors that may open to release commodities and may be closed while commodities are loaded or stored. Such doors may include a gap to facilitate closing. Although such gaps may be physically small, the gaps may enable inadvertent passage of at least some commodities.

Accordingly, a method and apparatus for reducing inadvertent passage of at least some commodities through a gap between the doors is desirable. Specifically, a door sealing assembly for the railcar will facilitate the decreasing inadvertent passage of commodities through the gap between the doors.

BRIEF DESCRIPTION

In one aspect, a railcar door sealing assembly is provided. The railcar includes a first door and a second door. The first door and the second door are positionable between a closed position and an open position and define a gap therebetween. The first door includes a first door plate and the second door includes a second door plate. The door sealing assembly includes a first door seal member coupled to the first door plate. The door sealing assembly also includes a second door seal member coupled to the second door plate. The first door seal member at least partially overlaps the second door seal member in a face-to-face relationship when the first door and the second door are in the closed position.

In another aspect, a railcar is provided. The railcar includes a first door including a first door plate. The railcar also includes a second door including a second door plate. The first door and the second door are positionable between a closed position and an open position and define a gap therebetween. The railcar additionally includes a door sealing assembly. The door sealing assembly includes a first door seal member coupled to the first door plate. The door sealing assembly also includes a second door seal member coupled to the second door plate. The first door seal member at least partially overlaps the second door seal member in a face-to-face relationship when the first door and the second door are in the closed position.

In another aspect, a method of assembling a railcar is provided. The method includes providing a first door including a first door plate. The method also includes coupling a second door including a second door plate to the first door, such that first door and second door are positionable between a closed position and an open position and define a gap therebetween. The method additionally includes coupling a first door seal member to the first door plate and coupling a second door seal member to the second door plate. The first door seal member at least partially overlaps the second door seal member in a face-to-face relationship when the first door and the second door are in the closed position.

DRAWINGS

FIG. 1 is a schematic side view of an example railcar;

FIG. 2 is an overhead perspective view of the example railcar shown in FIG. 1;

FIG. 3 is a schematic overhead view of the example railcar of FIG. 1 showing a hopper end sheet;

FIG. 4 is a schematic overhead view of the example railcar of FIG. 1 showing the view of components covered by the hopper end sheet shown in FIG. 3;

FIG. 5 is a schematic overhead view of an example door operating assembly that may be used with the railcar shown in FIG. 1;

FIG. 6 is a schematic longitudinal view of doors coupled to the door operating assembly shown in FIG. 5 further illustrating a door sealing assembly; and FIG. 7 is a schematic view of a portion of the door sealing assembly shown in FIG. 6 taken along area 7 showing the junction of a first door seal member and a second door seal member in greater detail.

DETAILED DESCRIPTION

The example methods and apparatus described herein overcome at least some disadvantages of known railcars by providing a door sealing assembly that reduces the risk of commodities loaded into the railcar from escaping through gaps or spaces between the doors located underneath the railcar. The methods and apparatus also facilitate reduction in the loss of such commodities, and cleaning and remediation of certain physical infrastructure contacted by falling commodities.

Figure 1:
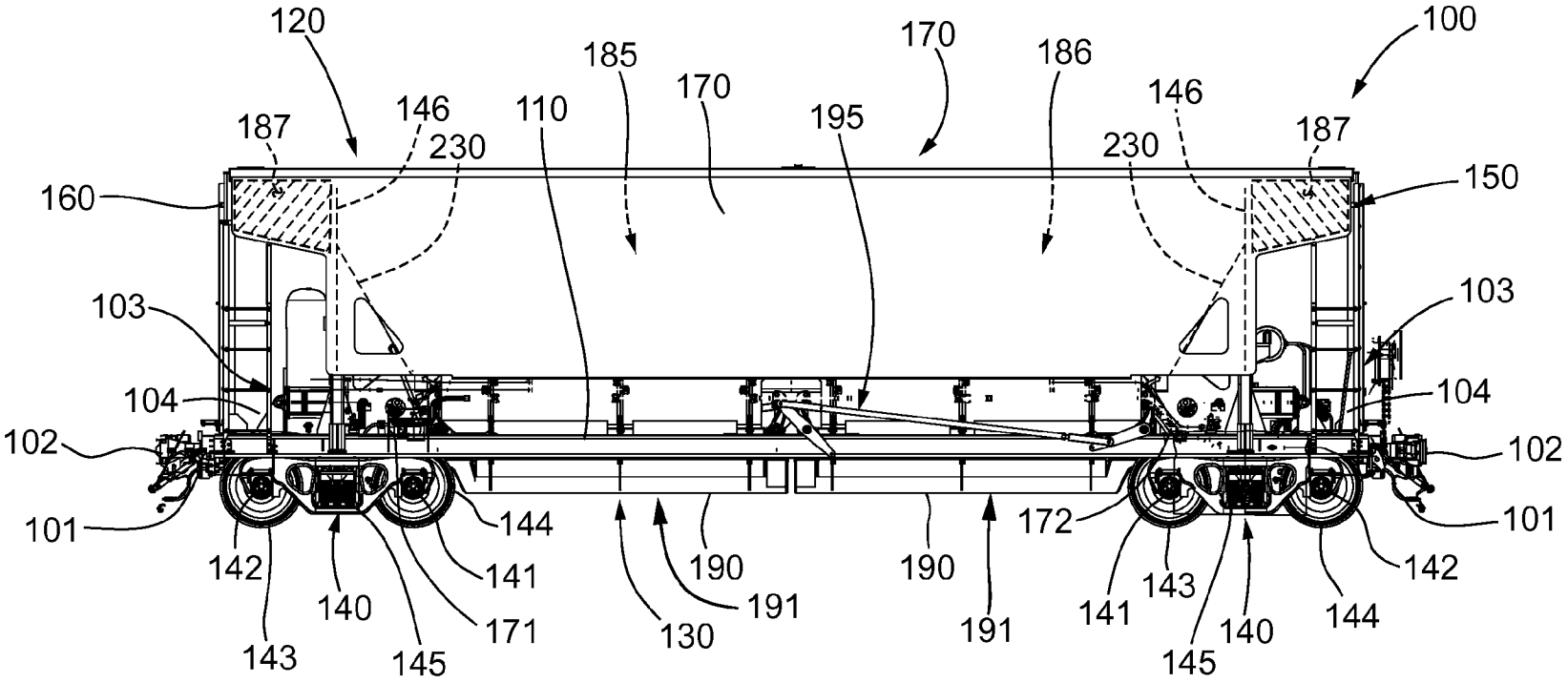
FIGS. 1-7 show example embodiments of the apparatus described herein.

FIG. 1 is a side view of an example railcar 100. In the example embodiment, railcar 100 is an open-top gondola car. Railcar 100 is used to store and/or transport materials or commodities, such as, without limitation, dried distillers' grains, dried distillers' grains with solubles, coal, and/or any other suitable granular and/or flowable commodity material. Alternatively, railcar 100 may be a closed-top transport vehicle. Also, alternatively, the apparatus described herein may be used with any type of railcar, e.g., without limitation, railway hopper cars, railway tank cars, and railway box cars.

In the example embodiment, railcar 100 includes a striker assembly 101 coupled to each end of a center sill assembly 110 and a coupling mechanism 102 coupled to each striker assembly 101. Railcar 100 also includes braking components 103 used to control the braking of railcar 100 during transit. Braking components 103 include, without limitation, hydraulic reservoir release rods and brake control valves (not shown). Railcar 100 also includes gate operating mechanisms 104. Gate operating mechanisms 104 include mechanisms to control the gate of railcar 100 including, without limitation, solenoids, tanks, and valves (not shown).

Also, in the example embodiment, railcar 100 includes an upper portion, i.e., a railcar container 120, which is coupled to a lower portion 130. Lower portion 130 includes center sill assembly 110. Lower portion 130 also includes a pair of truck assemblies 140 that each includes a pair of axles 141 and 142 that are coupled to a pair of wheels 143 and 144, respectively. Each truck assembly 140 also includes a bolster 145 that defines a bolster centerline 146. Railcar container 120 includes a front end structure 150, a rear end structure 160, and two opposing sidewalls 170 (a second opposing sidewall 170 shown obstructed by a first sidewall 170 in FIG. 1) extending therebetween, thereby at least partially defining a plurality of cargo cavities, i.e., hopper compartments 185 and 186. Center sill assembly 110 extends between front end structure 150 and rear end structure 160.

In the example embodiment, railcar 100 includes a plurality of hopper compartments 185 and 186 which are capable of being filled and emptied while railcar 100 is in motion. As used herein, hopper compartments 185 and 186 are used to receive and store commodities within railcar 100. Further, hopper compartments 185 and 186 are configured to be filled and emptied in unison and individually. Emptying operations are performed using a plurality of door operating assemblies (not shown in FIG. 1). Railcar 100 includes any number of hoppers and, accordingly, any number of associated hopper doors that enable operation of railcar 100 as described herein.

In addition to hopper compartments 185 and 186, railcar container 120, i.e., front end structure 150, rear end structure 160, and opposing sidewalls 170 further define supplemental commodity transport volumes 187 that represent additional portions of railcar 100 used to facilitate operations related to loading into railcar 100 and unloading commodities from railcar 100. Supplemental commodity transport volumes 187 are in flow communication with hopper compartments 185 and 186. In operation, supplemental commodity transport volumes 187 receive commodities and contain commodities therein.

Each hopper compartment 185 and 186 has at least one associated first door 190 and at least one second door 191 (second door 191 shown obstructed by a first door 190 in FIG. 1). Doors 190 and 191 are hingedly coupled to lower portion 130. First door 190 and second door are configured to facilitate containment of and release of commodities by using a door operating mechanism 195. Lower portion 130 additionally includes a pair of door supports 171 and 172 which provide support for first door 190. The location of door supports 171 and 172 facilitate a shorter railcar 100 because door supports 171 and 172 do not extend to axles 142.

Figure 2:
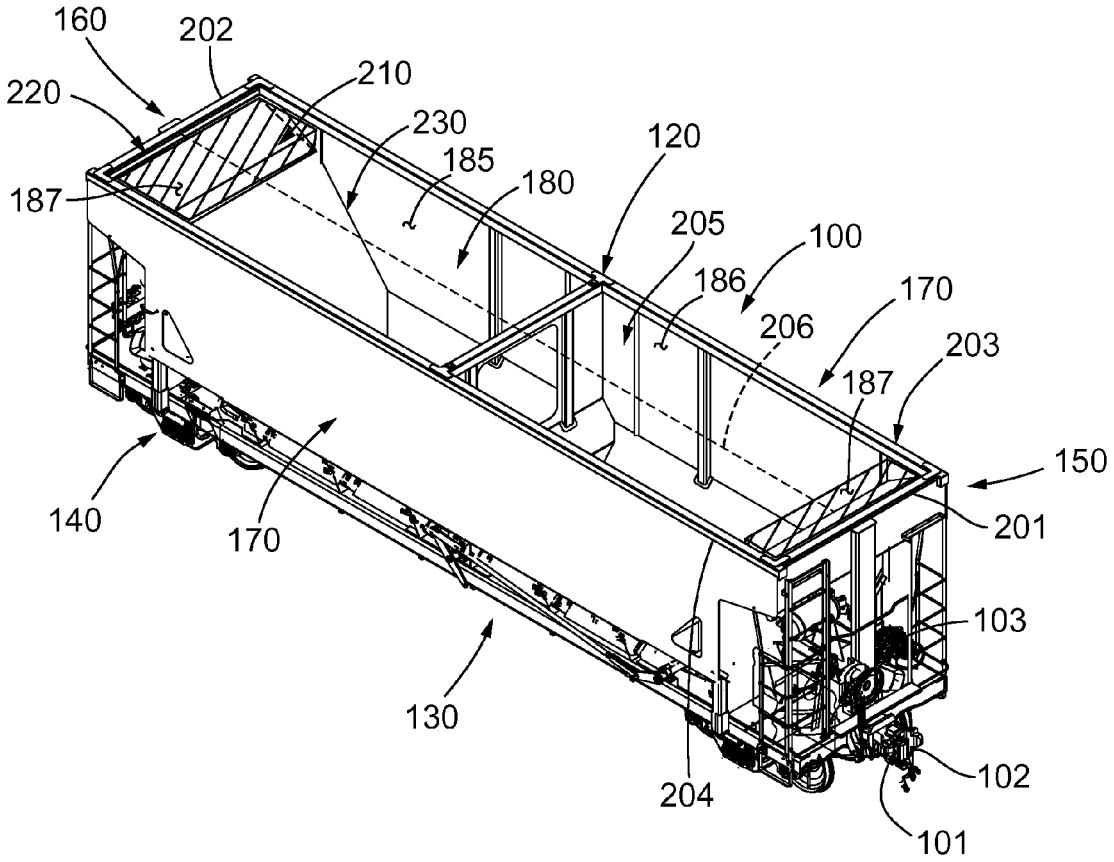

FIG. 2 is a schematic overhead perspective view of railcar 100. Railcar 100 includes a hopper end sheet 210. A front top edge 201 is defined by an upper portion of front end structure 150 and extends along the upper portion of front end structure 150. Similarly, a rear top edge 202 is defined by an upper portion of rear end structure 160 and extends along the upper portion of rear end structure 160. Additionally, a first lateral top edge 203 and a second lateral top edge 204 are defined on an upper portion of respective sidewall 170 and extend along the upper portion of respective sidewall 170. Railcar top plane 205 represents a plane defined by front top edge 201, rear top edge 202, first lateral top edge 203, and second lateral top edge 204. Railcar top plane 205 extends between edges 201, 202, 203, and 204. A railcar centerline longitudinal axis 206 is defined as extending between front top edge 201 and rear top edge 202.

Hopper end sheet 210 includes a first panel 220 and a second panel 230. First panel 220 is coupled to railcar 100 at front top edge 201 of front end structure 150. In the example embodiment, first panel 220 is also coupled to railcar 100 at rear top edge 202 of rear end structure 160. For first end structure 150, first panel 220 is coupled to front top edge 201 at a first angle with respect to railcar top plane 205. More specifically, first panel 220 is coupled to top edge 201 at a downward angle with respect to railcar top plane 205 within the range between approximately 20° and approximately 40°. Second panel 230 is coupled to first panel 220 at a second angle with respect to railcar top plane 205. More specifically, second panel 230 is coupled to first panel 220 at a downward angle with respect to railcar top plane 205 within the range between approximately 40° and approximately 65°. First panel 220 and second panel 230 for rear end structure 160 are substantially similar to those panels 220 and 230 for first end structure 150.

In the example embodiment, first panel 220 is a substantially rectangular flat panel. In the example embodiment, second panel 230 is a substantially flat panel. In alternative embodiments, first panel 220 and second panel 230 may be of any suitable shape to form hopper end sheet 210. The shape of hopper end sheet 210 facilitates loading commodities into hopper compartments 185. Although not shown in FIG. 2, a similar hopper end sheet 210 is used in conjunction with hopper compartment 186. The shape of hopper end sheet 210 also facilitates shielding at least a portion of braking components 103 and gate operating mechanisms 104 from direct sunlight. Hopper end sheet 210 additionally integrates supplemental commodity transport volume 187 into its design. First panel 220 extends longitudinally along railcar longitudinal axis 206 for a predetermined distance from second panel 230 such that first panel 220 can shield at least a portion of braking components 103 and gate operating mechanisms 104, from direct sunlight. First panel 220 defines a lower boundary for supplemental commodity transport volume 187. Therefore, supplemental commodity transport volume 187 defines a space which is used for storing, loading, and unloading commodities as well as for shielding at least a portion of braking components 103 and gate operating mechanism 104. In the example embodiment, braking components 103 and gate operating mechanisms 104 are substantially shielded from sunlight. In alternative embodiments, other components are shielded by hopper end sheet 210. In additional embodiments, other railcars (not shown) may be coupled to railcar 100 using coupling mechanism 102. At least a portion of braking components and gate operating mechanisms (not shown) of other railcars may additionally be substantially shielded from sunlight.

Figure 3:
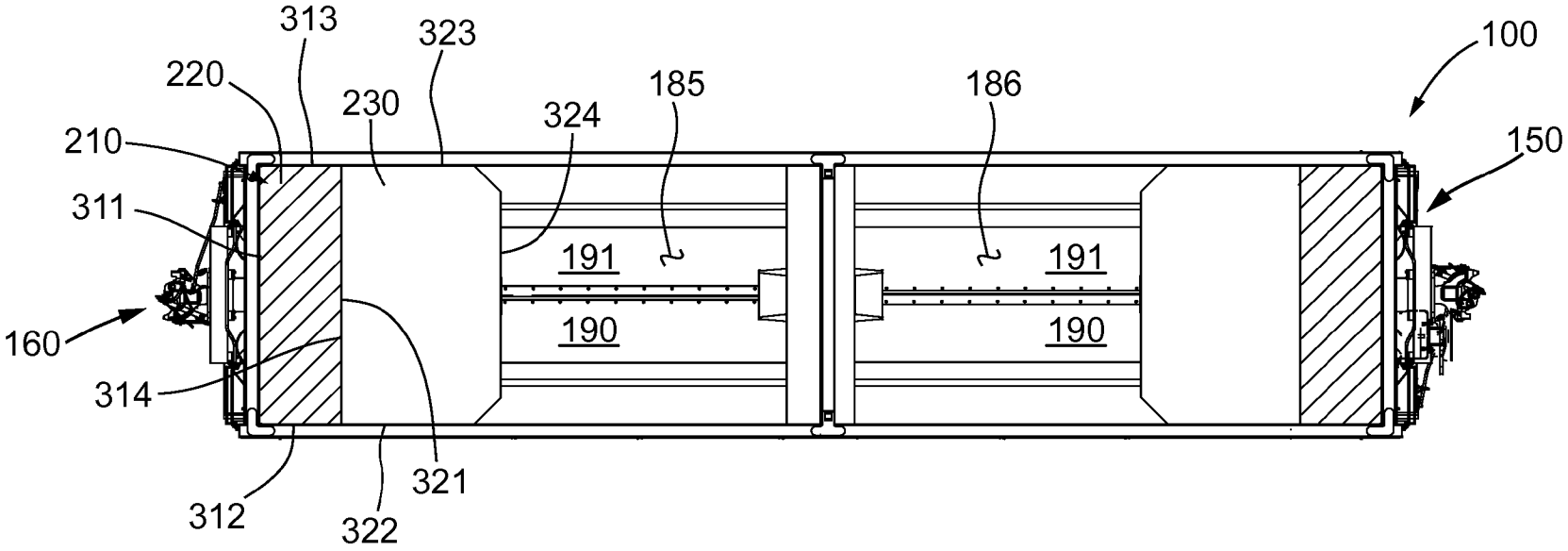

FIG. 3 is a schematic overhead view of railcar 100 showing an example hopper end sheet 210. In the example embodiment, railcar 100 is designed for top loading of commodities into railcar 100. As described above, hopper end sheet 210 includes a first panel 220 coupled to a second panel 230. Also, in the example embodiment, first panel 220 and second panel 230 are made of sheet metal. In alternative embodiments, first panel 220 and second panel 230 may be fabricated from any suitable material for receiving commodities including, for example, and without exception, alloys, composites, and durable plastics. First panel 220 includes an upper side 311, a first lateral side 312, a second lateral side 313, and a lower side 314. Accordingly, as described above, the shape of first panel 220 is substantially rectangular. Further, in the example embodiment, first panel 220 is coupled to railcar 100 through welding. In alternative embodiments, first panel 220 is coupled to railcar 100 using any appropriate method of coupling including, for example, and without limitation, adhesive bonding and mechanical fasteners. First panel 220 is coupled to railcar 100 at a downward angle. In the example embodiment, first panel 220 is additionally coupled to sidewalls 170 (shown in FIG. 2). First panel 220 extends slightly downward toward the base of first hopper compartment 185 within the range between 20° and 40° with respect to railcar top plane 205. In the example embodiment, first panel 220 extends downwards at approximately 30° with respect to railcar top plane 205. In alternative embodiments, first panel 220 extends at any angle suitable for the commodities loaded into railcar 100.

Second panel 230 includes an upper side 321, a first lateral side 322, a second lateral side 323, and a distal side 324. Second panel 230 is coupled to first panel 220 at the junction of lower side 314 and upper side 321. In the example embodiment, first panel 220 and second panel 230 are initially one panel (not shown) which is bent with a machine press to form two portions, first panel 220 and second panel 230. In an alternative embodiment, second panel 230 is coupled to first panel 220 through welding. In other alternative embodiments, second panel 230 is coupled to first panel 220 using any appropriate method of coupling including, for example, and without limitation, adhesive bonding and mechanical fasteners. In the example embodiment, second panel 230 is additionally coupled to sidewalls 170 using similar methods. Second panel 230 is coupled to first panel 220 at a downward angle. In other words, second panel 230 extends slightly downward into the base of first hopper compartment 185 at a steeper angle than first panel 220.

In operation, commodities are loaded into railcar 100 at first hopper compartment 185. At least a portion of commodities may land on hopper end sheet 210. Commodities generally slide down first panel 220 at a first speed and then accelerate down second panel 230 with a greater second speed. The angles chosen for first panel 220 and second panel 230 are chosen to mitigate the risk of damage to commodities while also facilitating the migration of commodities from hopper end sheet 210 to first hopper compartment 185. Enabling removal of commodities from hopper end sheet 210 reduces maintenance and cleaning required for hopper end sheet 210. By facilitating the migration of commodities to the base of railcar 100, hopper end sheet 210 additionally facilitates decreasing the falling of commodities onto the outer sections of railcar 100 such as coupling mechanism 102. Also, in operation, supplemental commodity transport volume 187 receives at least a portion of the commodities. Similar operations are used to load commodities into second hopper compartment 186.

Figure 4:
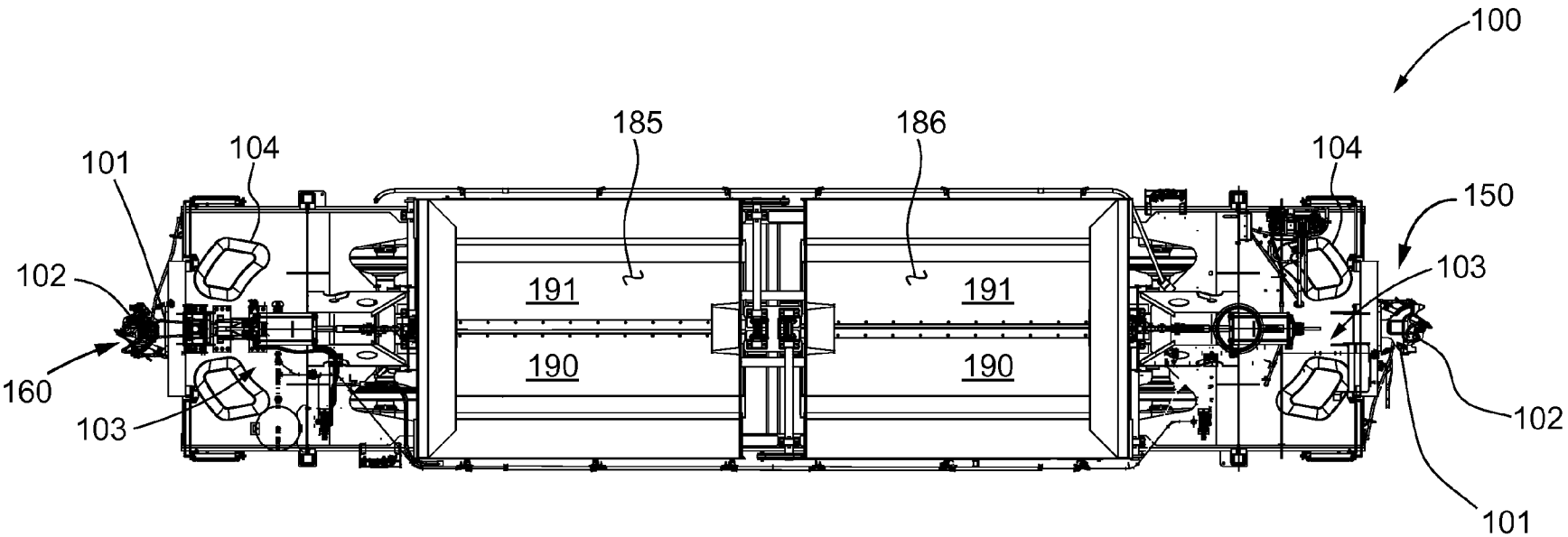

FIG. 4 is a schematic overhead view of railcar 100 showing the view of components 103 and 104 (i.e., braking components 103 and gate operating mechanisms 104) covered by hopper end sheet 210 (shown in FIGS. 1, 2, and 3). Hopper end sheet 210 is not visible in FIG. 4 because of the cutaway view. However, the cutaway view indicates that hopper end sheet 210 facilitates the reduction of direct sunlight on components 103 and 104. Accordingly, components 103 and 104 are exposed to less sunlight. Reduction of heat reduces adverse impact to human operators. Reduction of sunlight also reduces adverse impact to the service life of components 103 and 104. Also, in the event that there are residual commodities on components 103 and 104, reducing the direct sunlight reduces the potential for deleterious effects caused by the decomposition of commodities in sunlight.

Figure 5:
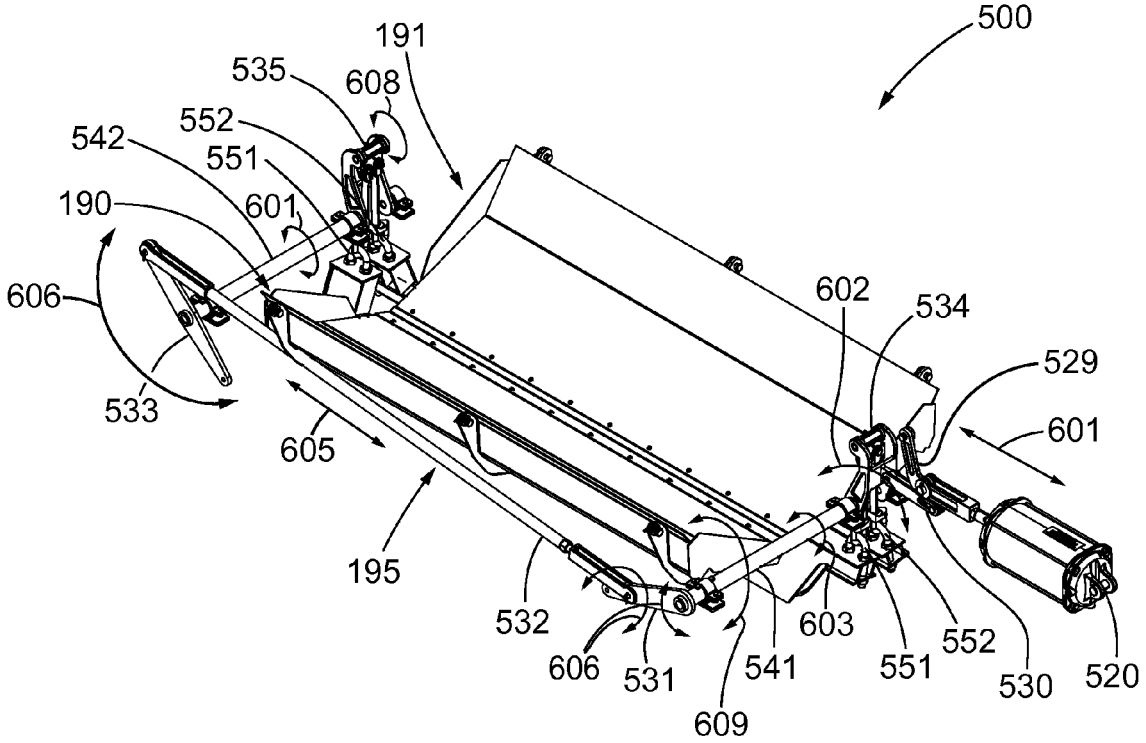

FIG. 5 is a schematic overhead perspective view of an example door operating assembly 500 that may be used with railcar 100 (shown in FIG. 1). Door operating assembly 500 functions to open and close first door 190 and second door 191. Door operating assembly 500 facilitates the release of commodities stored in hopper compartments 185 and 186 (shown in FIGS. 1-4). Door operating assembly 500 includes actuating device 520 and door operating mechanism 195. Actuating device 520 provides driving force to door operating assembly 500 and thereby facilitates the opening and closing of first door 190 and second door 191. In the example embodiment, actuating device 520 is a pneumatic actuator. In alternative embodiments, actuating device 520 may be a hydraulic actuator, an electric actuator, a mechanical actuator, or any other actuating device 520 capable of providing force to door operating assembly 500.

In the example embodiment, door operating mechanism 195 includes a plurality of door operating members, i.e., door operating mechanism 195 includes seven door operating members 529, 530, 531, 532, 533, 534, and 535. In alternative embodiments, a greater or lesser amount of door operating members are used. Specifically, in the example embodiment, door operating member 529 is a first extension arm 529 that is directly coupled to actuating device 520 and door operating member 530 is a second extension arm 530 that is coupled to extension arm 529 and door operating member 534. Also, in the example embodiment, door operating member 531 is a first exterior pivoting member 531, door operating member 532 is a third extension arm 532, door operating member 533 is a second exterior pivoting member 533, door operating member 534 is a first undercarriage pivoting member 534, and door operating member 535 is a second undercarriage pivoting member 535. In addition to actuating device 520 and door operating mechanism 195, door operating assembly 500 includes a front axial drive member 541, a rear axial drive member 542, and a plurality of door drive assemblies 551 and 552 Further, in the example embodiment, actuating device 520 is located on an external portion of railcar 100. Alternately, actuating device 520 is located in an internal portion of railcar 100.

Arcually translatable first undercarriage pivoting member 534 is pivotally coupled to actuating device 520 through longitudinally translatable extension arms 529 and 530. First undercarriage pivoting member 534 is further pivotally coupled to front axial drive member 541. Front axial drive member 541 is also pivotally coupled to first exterior pivoting member 531. Also, first exterior pivoting member 531 is pivotally coupled to longitudinally translatable extension arm 532. Further, extension arm 532 is pivotally coupled to second exterior pivoting member 533. Additionally, second exterior pivoting member 533 is pivotally coupled to rotatable rear axial drive member 542. Rear axial drive member 542 is pivotally coupled to second undercarriage pivoting member 535. Second undercarriage pivoting member 535 is coupled to door drive assemblies 551 and 552.

Door operating members 529, 530, 531, 532, 533, 534, and 535 are coupled within door operating assembly 500 in the manner described. In alternative embodiments, door operating members 529, 530, 531, 532, 533, 534, and 535 may be configured, oriented, and coupled in any suitable fashion to enable the operation of door operating mechanism 195, and thereby door operating assembly 500 as described herein As described herein, door operating mechanism 195 includes front axial drive member 541 and rear axial drive member 542. Front axial drive member 541 and rear axial drive member 542 are each coupled to door drive assemblies 551 and 552. Door drive assemblies 551 and 552 are coupled to first door 190 and second door 191, respectively. Door operating mechanism 195 facilitates the transfer of force provided by actuating device 520 through front axial drive member 541 and rear axial drive member 542 such that door drive assemblies 551 and 552 alternately raise and lower first door 190 and second door 191.

In operation, actuating device 520 induces a longitudinal force. More specifically, an operator (not shown) provides an input by, for example, and without limitation, pressing a button to activate actuating device 520 to open or close first door 190 and second door 191. Alternately, actuating device 520 may be triggered using a hot shoe system. A hot shoe system facilitates a device to be triggered by using a voltage potential to change from one state to a second state. For example, and without limitation, actuating device 520 can be triggered by a hot shoe system and accordingly cause doors 190 and 191 to alternately open and close.

Also, in operation, extension arms 529 and 530 translate longitudinally as shown by arrows 601, first undercarriage pivoting member 534 translates arcually as shown by arrows 602 and causes front axial drive member 541 to rotate as shown by arrows 603. Front axial drive member 541 pivotally translates first exterior pivoting member 531 as shown by arrows 604.

Further, in operation, first exterior pivoting member 531 causes extension arm 532 to longitudinally translate extension arm 532, second exterior pivoting member 533 pivotally translates as shown by arrows 605, second exterior pivoting member 533 causes rear axial drive member 542 to rotate as shown by arrows 607, rear axial drive member 542 causes second undercarriage pivoting member 535 to translate arcually as shown by arrows 608, and second undercarriage pivoting member 535 causes door drive assemblies 551 and 552 to move and thereby alternately open and close doors 190 and 191, where door drive assemblies 551 and 552 translate doors 190 and 191 arcually, respectively, as shown by arrows 609 (shown for door 190 only).

In at least some embodiments, door operating assembly 500 is operated manually. For example, if actuating device 520 is functionally unavailable due to service or maintenance issues, door operating assembly 500 can still function through mechanical motion. In one example, front axial drive member 541 can be moved using, for example, and without limitation, a comealong (not shown). In such an example, applying force to door operating assembly 500 can cause doors 190 and 191 to move from an open to a closed position. Alternately, rear axial drive member 542 may be moved using a comealong. In the example, applying force to door operating assembly 500 can cause doors 190 and 191 to move from a closed to an open position. Such methods of operating door operating assembly 500 may be advantageous in the event of the failure of a power source, such as the source of power for actuating device 520.

Door operating assembly 500 is additionally designed to facilitate the discharge of commodities while railcar 100 is standing in one location or in motion. Further, the design of door operating assembly 500 facilitates the discharge of such commodities between the rails of a railtrack. Door operating assembly 500 may additionally be used in railcars 100 with a plurality of hoppers. Accordingly, door operating assembly 500 may be used to allow the unloading of commodities from selected hoppers or all hoppers.

Figure 6:
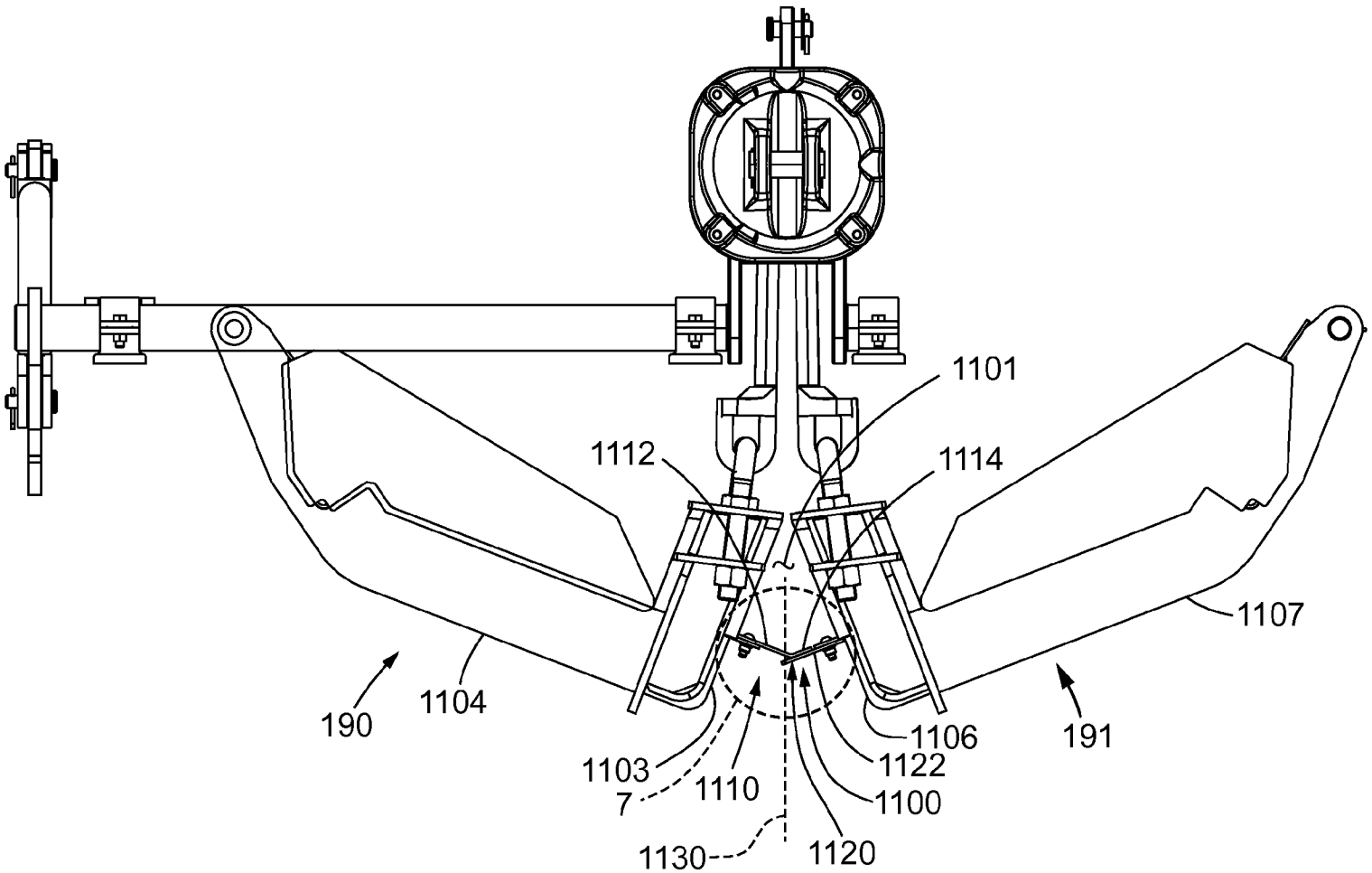
Figure 7:
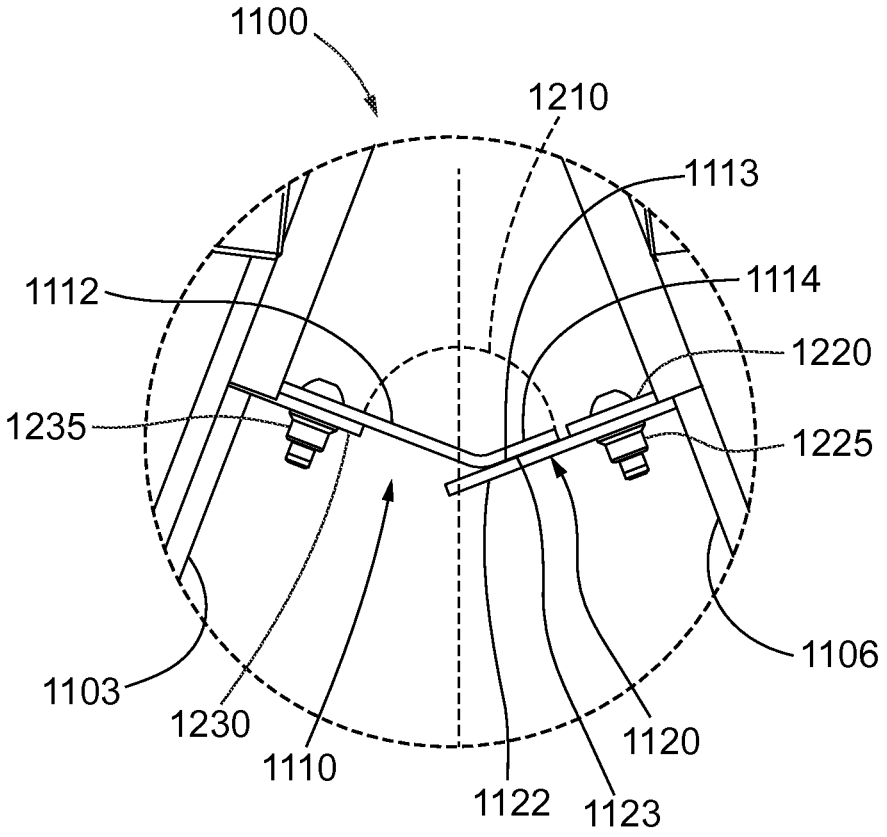

FIG. 6 is a schematic longitudinal view of doors 190 and 191 coupled to door operating assembly 500 (shown in FIG. 5) further illustrating an example door sealing assembly 1100. FIG. 7 is a schematic magnified view of a portion of door sealing assembly 1100 (shown in FIG. 6) taken along area 7 showing example first door seal member 1110 and example second door seal member 1120 in greater detail.

In FIG. 6, first door 190 and second door 191 are in a closed position. First door 190 and second door 191 are positionable between a closed position and an open position. However, a gap 1101 is defined between first door 190 and second door 191 in the closed position, such that gap 1101 may facilitate commodities to pass through. First door 190 includes a first door plate 1103 and a first lower panel 1104. Second door 191 includes a second door plate 1106 and a second lower panel 1107.

Door sealing assembly 1100 facilitates significantly reducing commodities from passing through gap 1101. Door sealing assembly 1100 includes a first door seal member 1110 and a second door seal member 1120. First door seal member 1110 is coupled to first door 190 and second door seal member 1120 is coupled to second door 191. More specifically, first door seal member 1110 is coupled to first door 190 at a first door plate 1103 such that first door seal member 1110 initially extends outward in parallel with first lower panel 1104. First door seal member 1110 is perpendicular with first door plate 1103. Similarly, second door seal member 1120 is coupled to second door 191 at a second door plate 1106 such that second door seal member 1120 extends outward in parallel with second lower panel 1107. Second door seal member 1120 is additionally perpendicular with second door plate 1106. In alternative embodiments, first door seal member 1110 may be coupled to first door 190 such that first door seal member 1110 initially extends outward at any angle from first lower panel 1104. Similarly, in alternative embodiments, second door seal member 1120 may be coupled to second door 191 such that second door seal member 1120 initially extends outward at any angle from second lower panel 1107.

First door seal member 1110 and second door seal member 1120 are shaped such that, when first door 190 and second door 191 are in a closed position, door sealing assembly 1100 provides a closed seal which significantly reduces commodities passing through gap 1101. Area 7 of FIG. 6 shows the junction of first door seal member 1110 and second door seal member 1120.

Referring to FIGS. 6 and 7, first door seal member 1110 includes a first fastening member 1230, a first portion 1112, and a second portion 1114. First fastening member 1230 is coupled to first door plate 1103. In the example embodiment, first fastening member 1230 is welded to first door plate 1103. In alternative embodiments, first fastening member 1230 may be coupled to first door plate 1103 using mechanical fasteners, adhesives, or any other appropriate method of coupling. First portion 1112 extends from first fastening member 1230 using first fastener 1235 with a friction fit. In the example embodiment, first fastener 1235 includes a bolted fastening mechanism. In alternative embodiments, first fastener 1235 may include any suitable method of fastening first fastening 1235 member to first portion 1112. First portion 1112 is coupled to second portion 1114 at an angle 1210 which causes second portion 1114 to be parallel to second door seal member 1120 and second lower panel 1107.

Second door seal member 1120 includes a second fastening member 1220 and a third portion 1122. Second fastening member 1220 is coupled to second door plate 1106. In the example embodiment, second fastening member 1220 is welded to second door plate 1106. In alternative embodiments, second fastening member 1220 may be coupled to second door plate 1106 using mechanical fasteners, adhesives, or any other appropriate method of coupling. Third portion 1122 is coupled to second fastening member 1220 using second fastener 1225 with a friction fit. In the example embodiment, second fastener 1225 includes a bolted fastening mechanism. In alternative embodiments, second fastener 1225 may include any suitable method of fastening second fastening member 1225 to third portion 1122. Third portion 1122 is parallel to second portion 1114 and second lower panel 1107.

Coupling angle 1210 causes second portion 1114 to overlap with second door seal member 1120 when first door 190 and second door 191 are in a closed position. In the example embodiment, coupling angle 1210 is approximately 120 degrees. However, in alternative embodiments, any coupling angle 1210 suitable for the apparatus described may be used. In the example embodiment, second door seal member 1120 extends partially past centerpoint 1130 of door sealing assembly 1100 and accordingly second door seal member 1120 extends under first door seal member 1110. More specifically, second door seal member 1120 extends under first portion 1112. The overlapping nature of first door seal member 1110 and second door seal member 1120 further significantly reduce commodities passing through gap 1101 from passing through door sealing assembly 1100. More specifically, first door seal member 1110 and second door seal member 1120 overlap in a face-to-face relationship. First door seal member 1110 includes a first outer face 1113 and second door seal member 1120 includes a second outer face 1123. When first door 190 and second door 191 are in a closed position, first outer face 1113 and second outer face 1123 are in a face-to-face relationship.

In operation, first door 190 and second door 191 may open and close synchronously or asynchronously. In the example embodiment, doors 190 and 191 are opened synchronously. In an alternative embodiment, second door 191 opens first and first door 190 opens after a delay. In additional alternative embodiments, first door 190 may open first and second door 191 may open after a delay. Also, when hopper compartments 185 and 186 contains commodities and first door 190 and second door 191 are opened, the commodities may pass through gap 1101 initially before passing to door sealing assembly 1100 and finally passing through door sealing assembly 1100 when first door 190 and second door 191 are sufficiently separated that first door seal member 1110 and second door seal member 1120 no longer form a seal.

A method of assembling railcar 100 includes providing first door 190 including first door plate 1103. The method also includes coupling second door 191 including second door plate 1106 to first door 190, such that first door 190 and second door 191 are positionable between a closed position and an open position and define a gap therebetween. The method additionally includes coupling first door seal member 1110 to first door plate 1103 of first door 190. The method also includes coupling second door seal member 1120 to second door plate 1106 of second door 191, wherein first door seal member 1110 at least partially overlaps with second door seal member 1120 in a face-to-face relationship when first door 190 and second door 191 are in the closed position.

As described herein, door sealing assembly 1100 is used to assemble railcar 100. Alternatively, door sealing assembly 1100 may be used with alternative railcars to provide the benefits and effects described herein.

The example methods and apparatus described herein overcome at least some disadvantages of known railcars by providing a door sealing assembly that reduces the risk of commodities loaded or stored in the railcar from passing through gaps in the doors of a railcar. The methods and apparatus also facilitate reduction in the loss of commodities. The method and apparatus additionally reduce the maintenance and remediation resulting from commodity loss.

Additionally, example embodiments of a door sealing assembly for a railcar and method of assembling/fabricating the same are described above in detail. The door sealing assembly and method are not limited to the specific embodiments described herein, but rather, components of apparatus and/or steps of the method may be utilized independently and separately from other components and/or steps described herein. For example, the door sealing assembly may also be used in combination with other railcar and associated assembly/fabrication methods, and are not limited to practice with only the railcar and assembly/fabrication methods as described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A railcar door assembly, comprising:

a first door and a second door at least partially cooperating to define a compartment configured to receive commodities therein, the first door and the second door movable relative to one another between a closed position and an open position;

a first door seal member extending from the first door, the first door seal member including a first portion having an upper surface facing the compartment and a lower surface opposite the upper surface of the first portion and a second portion having an upper surface facing the compartment and a lower surface opposite the upper surface of the second portion, the second portion extending from the first portion at an angle such that the upper surface of the first portion and the upper surface of the second portion form a concave configuration positioned within the compartment when the first door and the second door are in the closed position; and a second door seal member extending from the second door, the second door seal member having an upper surface facing the compartment and a lower surface opposite the upper surface of the second door seal member, the upper surface of the second door seal member being in face-to-face contact with the lower surface of the second portion of the first door seal member and extending beyond the second portion of the first door seal member and under the first portion of the first door seal member when the first door and the second door are in the closed position.

2. The railcar door assembly in accordance with claim 1, wherein said second portion of the first door seal member is substantially parallel with said second door seal member when the first door and the second door are in the closed position.

3. The railcar door assembly in accordance with claim 1, wherein the first door and the second door are spaced from one another so as to define a centerline between the first door and the second door, wherein the first portion of the first door seal member extends across the centerline, and wherein the second door seal member extends across the centerline.

4. The railcar door assembly in accordance with claim 1, wherein the first door further includes a first lower panel, and wherein said first door seal member extends from the first door parallel to the first lower panel.

5. The railcar door assembly in accordance with claim 4, wherein the second door further includes a second lower panel, and wherein said second door seal member extends from the second door parallel to the second lower panel.

6. A railcar, comprising:

a railcar container supported on a plurality of truck assemblies and defining at least one hopper compartment configured to receive commodities therein;

a first door hinged to a lower portion of the railcar container;

a second door hinged to the lower portion of the railcar container, wherein the first door and the second door are movable relative to one another between a closed position and an open position; and a door sealing assembly comprising:

a first door seal member extending from the first door, the first door seal member including a first portion having an upper surface facing the compartment and a lower surface opposite the upper surface of the first portion and a second portion having an upper surface facing the compartment and a lower surface opposite the upper surface of the second portion, the second portion extending from the first portion at an angle such that the upper surface of the first portion and the upper surface of the second portion form a concave configuration positioned within the compartment when the first door and the second door are in the closed position; and a second door seal member extending from the second door, the second door seal member having an upper surface facing the compartment and a lower surface opposite the upper surface of the second door seal member, the upper surface of the second door seal member being in face-to-face contact with the lower surface of the second portion of the first door seal member and extending beyond the second portion of the first door seal member and under the first portion of the first door seal member when the first door and the second door are in the closed position.

7. The railcar in accordance with claim 6, wherein said second portion is substantially parallel with said second door seal member when said first door and said second door are in the closed position.

8. The railcar in accordance with claim 6, wherein the first door and the second door are spaced from one another so as to define a centerline between the first door and the second door, wherein the first portion of the first door seal member extends across the centerline, and wherein the second door seal member extends across the centerline.

9. The railcar in accordance with claim 6, wherein said first door further includes a first lower panel, and wherein said first door seal member extends from said first door parallel to said first lower panel.

10. The railcar in accordance with claim 9, wherein said second door further includes a second lower panel, and wherein said second door seal member extends from said second door parallel to said second lower panel.

* * * * *